US008757170B2

(12) United States Patent
Kaplani

(10) Patent No.: US 8,757,170 B2
(45) Date of Patent: Jun. 24, 2014

(54) WATERLESS ELECTRONIC HOOKAH MACHINE

(71) Applicant: Firas Kaplani, Wheeling, IL (US)

(72) Inventor: Firas Kaplani, Wheeling, IL (US)

( * ) Notice: Subject to any disclaimer, the term of this patent is extended or adjusted under 35 U.S.C. 154(b) by 0 days.

(21) Appl. No.: 13/624,061

(22) Filed: Sep. 21, 2012

(65) Prior Publication Data

US 2014/0083441 A1 Mar. 27, 2014

(51) Int. Cl.
*A24F 47/00* (2006.01)

(52) U.S. Cl.
USPC ..... 131/273; 131/194; 131/329; 131/330; 131/257

(58) Field of Classification Search
CPC ..... A24F 1/30
USPC ..... 131/173, 273, 172, 223, 229, 257, 131/328–330
See application file for complete search history.

(56) References Cited

U.S. PATENT DOCUMENTS

| | | | | |
|---|---|---|---|---|
| 7,404,405 | B1 * | 7/2008 | Mehio | 131/173 |
| 2009/0283103 | A1 * | 11/2009 | Nielsen et al. | 131/273 |
| 2010/0212679 | A1 * | 8/2010 | Bishara | 131/173 |
| 2012/0042884 | A1 * | 2/2012 | Mukaddam | 131/173 |
| 2013/0220350 | A1 * | 8/2013 | Zakayan | 131/257 |

FOREIGN PATENT DOCUMENTS

WO WO 2011/075722 A2 * 6/2011

OTHER PUBLICATIONS

Kanara, Mar. 8, 2011, http://www.thehookah.com/hookah-blog/hookah-news/new-kanara-mouth-tips-available-in-male-and-female.html.*

* cited by examiner

*Primary Examiner* — Philip Tucker
*Assistant Examiner* — Eric Yaary
(74) *Attorney, Agent, or Firm* — Justin Lampel

(57) ABSTRACT

The present device generally relates to a waterless electronic hookah machine. The waterless electronic hookah machine has a main body portion, a handle section and a flexible wire cable (or "connector"). The flexible wire cable electrically connects the main body portion with the handle section. The handle section has a removable mouthpiece containing a cartridge having a liquid. When a user activates a push button or vacuum switch on the handle section, a power source in the main body portion sends power through the flexible wire cable to an atomizer located in the handle section which then heats the liquid in the cartridge of the mouthpiece and a vapor is created for the user to inhale. The device allows multiple users (generally up to six) to use the device at the same time wherein each user may experience a different flavor smoke. Flavors may be easily switched without the need to rinse out the electronic hookah machine. The user is able to adjust the voltage going to the handle.

15 Claims, 5 Drawing Sheets

WATERLESS ELECTRONIC HOOKAH MACHINE

BACKGROUND OF THE INVENTION

The present device generally relates to a waterless electronic hookah machine. The waterless electronic hookah machine has a main body portion, a handle section and a flexible wire cable (or "connector"). The flexible wire cable electrically connects the main body portion with the handle section. The handle section has a removable mouthpiece containing a cartridge having a liquid. When a user activates a push button or vacuum switch on the handle section, a power source in the main body portion sends power through the flexible wire cable to an atomizer located in the handle section which then heats the liquid in the cartridge of the mouthpiece and a vapor is created for the user to inhale. The device allows multiple users (generally up to six) to use the device at the same time wherein each user may experience a different flavor smoke. Flavors may be easily switched without the need to rinse out the electronic hookah machine. The user is able to adjust the voltage going to the handle.

As a result of the health issues and restrictions on locations associated with permissible smoking, people have attempted to move away from the traditional smoking of tobacco. For example, U.S. Pat. No. 8,205,622 to Pan discloses an electronic cigarette having two tubes that resemble a cigarette: an electronic inhaler and an electronic atomizer. The two tubes are connected through one or more electric connectors to form an electronic cigarette. Inside the inhaler is a rechargeable or non-rechargeable power source such as a battery, which supplies electric power to the electronic inhaler and atomizer and ensures that both work together like a cigarette. In addition to the power source, the inhaler also includes other major components: an electric airflow sensor to detect air movement generated by a user's inhaling or puffing act and a Single Chip Micyoco which controls the atomization process. The sensor's role is to collect an airflow signal that triggers the Single Chip Micyoco, which in turn instructs the electronic cigarette to supply electric power to the inhaler and atomizer connected through an electric connector. Inside the electronic atomizer are an electric connector, electric heating wire, liquid container, and atomizer cap with an air-puffing hole. The user inhales through the air-puffing hole at an end of the electronic cigarette to create an air inflow, which triggers the atomization process. The Single Chip Micyoco driven by a software program controls the electronic cigarette in an on/off manner according to the signal detected by the electric sensor on the airflow and completes a cycle of atomization, which converts a solution of a liquid form inside the liquid container to a gas form. This entire process achieves the emulated smoking process of a user, who is satisfied with scent taste that mimics cigarette smoking.

Further, U.S. Pat. No. 7,845,359 to Montaser discloses an artificial cigarette, inhaler or other nebulizer device having a housing, an air passage into the housing, a fog generator chamber within the housing connected to the air passage, a liquid source connected to the fog generating chamber, and a fog generator within the fog generating chamber for receiving liquid from the liquid source and creating an aerosol. The fog generator may be an ultrasonic nebulizer and/or a pneumatic nebulizer.

However, these electronic smoking machines fail to disclose a waterless electronic hookah machine which allows a user to quickly and easily change the flavor of the hookah smoke. A need, therefore, exists for an improved electronic hookah machine which is safe, sanitary and easy to use.

SUMMARY OF THE INVENTION

The present device generally relates to a waterless electronic hookah machine. The waterless electronic hookah machine has a main body portion, a handle section and a flexible wire cable (or "connector"). The flexible wire cable electrically connects the main body portion with the handle section. The handle section has a removable mouthpiece containing a cartridge having a liquid. When a user activates a push button or vacuum switch on the handle section, a power source in the main body portion sends power through the flexible wire cable to an atomizer located in the handle section which then heats the liquid in the cartridge of the mouthpiece and a vapor is created for the user to inhale. The device allows multiple users (generally up to six) to use the device at the same time wherein each user may experience a different flavor smoke. Flavors may be easily switched without the need to rinse out the electronic hookah machine. The user is able to adjust the voltage going to the handle.

An advantage of the present electronic hookah machine is to provide a hookah machine which requires almost no cleaning.

Yet another advantage of the present electronic hookah machine is that the present device allows a user to quickly and easily change the flavor of the hookah smoke.

And an advantage of the present electronic hookah machine is that the present device has a plurality of LED lights which allow a user to easily determine if the machine is on.

Still another advantage of the present electronic hookah machine is that the present electronic hookah machine may have an automatic vacuum activated switch located on the handle portion wherein the user can activate the device by merely inhaling on the mouthpiece.

And another advantage of the present electronic hookah machine is that the present machine may allow multiple users (through multiple handles) to use the hookah machine at the same time wherein each person may experience a different flavor.

Yet another advantage of the present electronic hookah machine is that the present hookah machine is sanitary in that is lacks water.

And an advantage of the present electronic hookah machine is that the hookah machine allows a user to adjust the voltage going to the handle section.

And another advantage of the present waterless electronic hookah machine is that the present device allows for the easy changing of the mouthpieces.

Still another advantage of the present electronic hookah machine is that the present electronic hookah machine is lightweight and easily portable.

For a more complete understanding of the above listed features and advantages of the waterless electronic hookah machine reference should be made to the following detailed description of the preferred embodiments and to the accompanying drawings.

DETAILED DESCRIPTION OF THE PREFERRED EMBODIMENTS

The present device generally relates to a waterless electronic hookah machine. The waterless electronic hookah machine has a main body portion, a handle section and a flexible wire cable (or "connector"). The flexible wire cable electrically connects the main body portion with the handle section. The handle section has a removable mouthpiece containing a cartridge having a liquid. When a user activates a push button or vacuum switch on the handle section, a power source in the main body portion sends power through the flexible wire cable to an atomizer located in the handle section which then heats the liquid in the cartridge of the mouthpiece and a vapor is created for the user to inhale. The device allows multiple users (generally up to six) to use the device at the same time wherein each user may experience a different flavor smoke. Flavors may be easily switched without the need to rinse out the electronic hookah machine. The user is able to adjust the voltage going to the handle.

Figure 1:
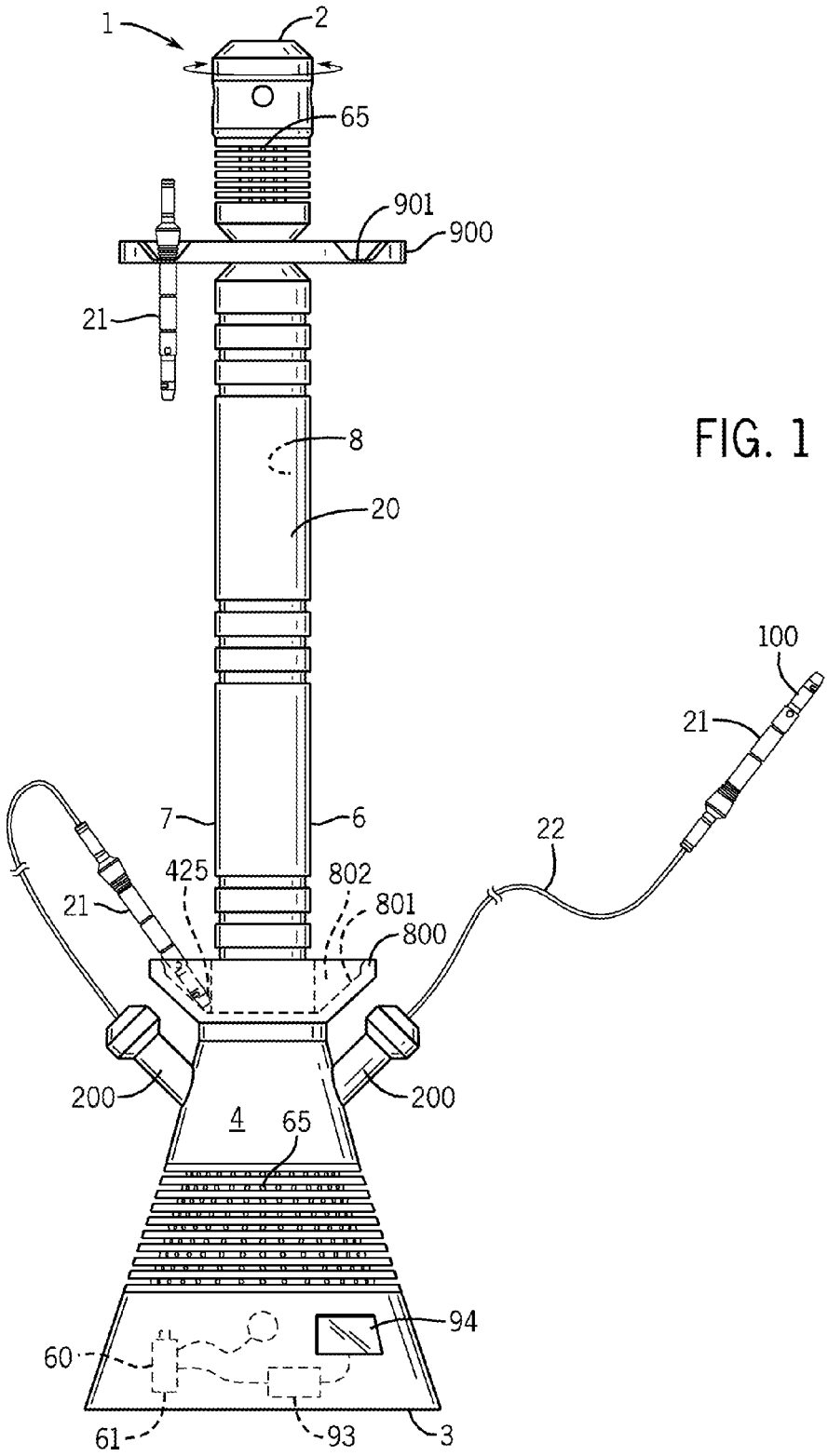
FIG. 1 illustrates a front view of the waterless electronic hookah machine.

Referring to FIG. 1, an electronic hookah machine 1 is provided. The electronic hookah machine 1 may have a main body portion 20 having a top 2, a bottom 3, a front 4, a back, a first side 6, a second side 7, and an interior 8. In the drawings, the main body portion 20 is illustrated in a generally cylindrical in nature; however, any suitable shape may be used. The electronic hookah machine 1 may further have a handle section 21 (FIG. 2) which is electrically connected to the main body 20 by a flexible wire cable 22.

Figure 2:
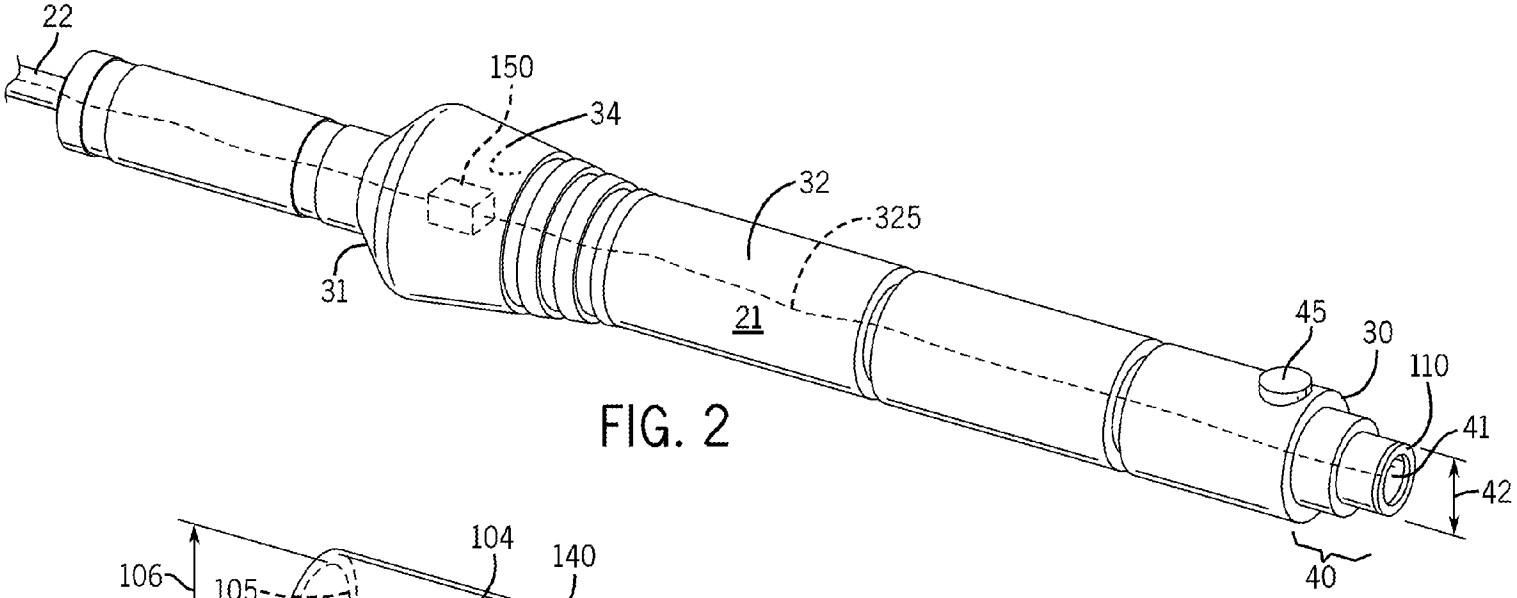
FIG. 2 illustrates a perspective view of the handle section of the electronic hookah machine.

Referring now to FIG. 2, the handle section 21 may have first end 30, a second end 31, a generally cylindrical exterior surface 32 and an interior 34. The first end 30 of the handle section 21 may have an extending male protrusion section 40 which has a circumference less than the main portion of the generally cylindrical exterior surface 32 of the handle section 21. The extending male protrusion section 40 may have an opening 41 having a diameter 42.

In an embodiment, the handle section 21 is removable and replaceable by an alternative handle section 21 in order to, for example, repair, replace or clean the handle section 21 or may be replaced with another handle section 21 for purely ornamental reasons. Although FIG. 1 illustrates two handle sections 21 and two flexible wire cables 22 attached to the main body 20 of the electronic hookah machine 1, it should be understood that the electronic hookah machine 1 may have multiple handle sections 21 (for example six) connected to the main body section 20 by multiple flexible wire cables 22. As a result, many people can enjoy the electronic hookah machine 1 simultaneously.

Located near the first end 30 of the handle section 21 may be a button 45. The button 45, when pressed, may activate the electronic hookah device 1 and allow a user to inhale smoke (as further discussed below). The button 45 may mechanically produce an electrical contact with the electronic flexible wire cable 22 which, in turn, is electrically connected to a power source 60 (FIG. 1) located within the interior 8 of the main body 20 of the electronic hookah machine 1. The power source 60 may be a DC battery 61 or the device 1 may be plugged in a wall outlet for AC current.

In an embodiment, an adjustable voltmeter 93 may also be located within the interior 8 of the main body section 20 of the electronic hookah machine 1. The adjustable voltmeter 93 may be electrically connected to the power source 60 and may measure the voltage the power source 60 sends to each of the plurality of handle sections 21. Preferably, the adjustable voltmeter 93 can measure at least one to eight volts per handle section 21. Further, the adjustable voltmeter 93 may have a visible LED display and control 94 located on the surface of the main body portion 20 of the device 1 wherein the user can view and adjust the voltage of the device 1. More specifically, the user may adjust the voltage of the device 1 in order to increase or decrease the amount of smoke the device 1 produces.

Located within the interior 34 of the handle section 21 may be a heating element (or "atomizer") 150. The heating element 150 may be electrically connected to the power source 60 (as defined below) located in the main body 20 of the device 1 via the flexible wire cable 22.

Figure 3:
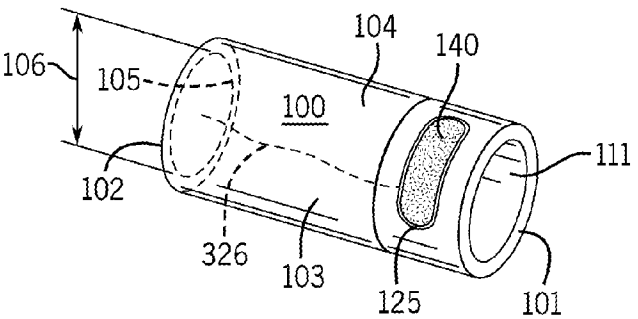
FIG. 3 illustrates a perspective view of the removable mouthpiece of the electronic hookah machine.

Referring now to FIG. 3, a removable mouthpiece 100 may be temporarily secured to the handle section 21. More specifically, the removable mouthpiece 100 may be temporarily secured to the extending male protrusion section 40 of the handle section 21.

The removable mouthpiece 100 may have a first end 101, a second end 102, a generally cylindrical exterior surface 103 and an interior 104. Preferably, the removable mouthpiece 100 is available in multiple colors and shapes. The second end 102 of the removable mouthpiece 100 may be a female connection point having an opening 105 having a diameter 106. The diameter 106 of the opening 105 of the removable mouthpiece 100 may be slightly larger than the diameter 42 of the opening 41 of the extending male protrusion section 40 such that the removable mouthpiece 100 may snap onto and remain secured to the handle section 21. A rubber or metal gasket 110 may provide a liquid and air tight seal between the removable mouthpiece 100 and the handle section 21.

A removable cartridge 125 may be located in the interior 104 of the removable mouthpiece 100 of the electronic hookah machine 1. The removable cartridge 125 may hold a liquid 140. In an embodiment, the liquid 140 may be a propylene glycol or glycerin based liquid. Nicotine may be added to the liquid 140 if desired.

Figure 5:
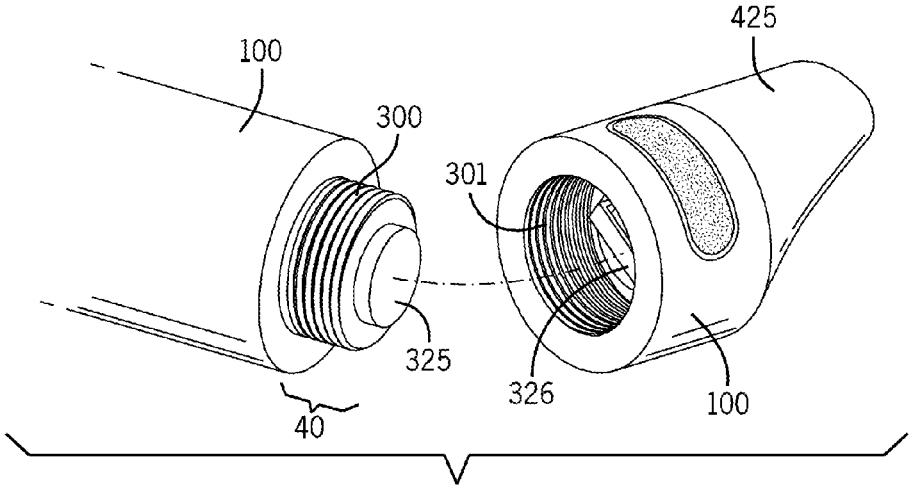
FIG. 5 illustrates an exploded view of the removable cartridge being secured to the handle section.

Referring now to FIG. 5, the removable mouthpiece 100 may be temporarily secured to the handle section 21 by, for example, a helical threaded portion 300 located on the extending male protrusion section 40 of the handle section 21 which mates with a corresponding helical threaded portion 301 located within the opening 105 of the second end 102 of the removable mouthpiece 100. It should be noted that, in an embodiment, the threading of the removable mouthpiece 100 and the handle section 21 may be easily reversed as well as the male/female connections.

When the removable mouthpiece 100 is screwed or snapped onto the handle section 21, an electrical wire contact 325 located in the extending male protrusion section 40 of the handle section 21 may then electrically connect with an extended electrical wire contact 326 located at the second end 102 of the removable mouthpiece 100. The electrical wire contact 325 of the handle section 21 may be electrically connected to the heating element 150 whereas the extended electrical wire contact 326 of the removable mouthpiece 100 is electrically connected to the removable cartridge 125 containing the liquid 140. To remove the removable mouthpiece 100 from the handle section 21, a user merely unscrews or unsnaps the removable mouthpiece 100 and the electrical circuit is broken.

When the user draws a breath in while holding the button 45 located on the handle section 21, the heating element 150 located in the handle section 21 provides heat to the liquid 140 which in turn vaporizes the liquid 140 into a smoke. The vapor is essentially the same smoke as is commonly seen in nightclubs, concerts and theater fog generators for special effects. The vapor may contain a variety of flavors such as chocolate, mint, tobacco, apple, and many others. The user may then put his or her mouth on an opening 111 at the first end 101 of the removable mouthpiece 100 and inhale the vapor. As a result of placing the removable cartridge 125 holding the liquid 140 in the removable mouthpiece 100 instead of in the main body section 20, multiple users may use the same electronic hookah machine 1 at the same time and each may experience a different flavor.

Figure 4:
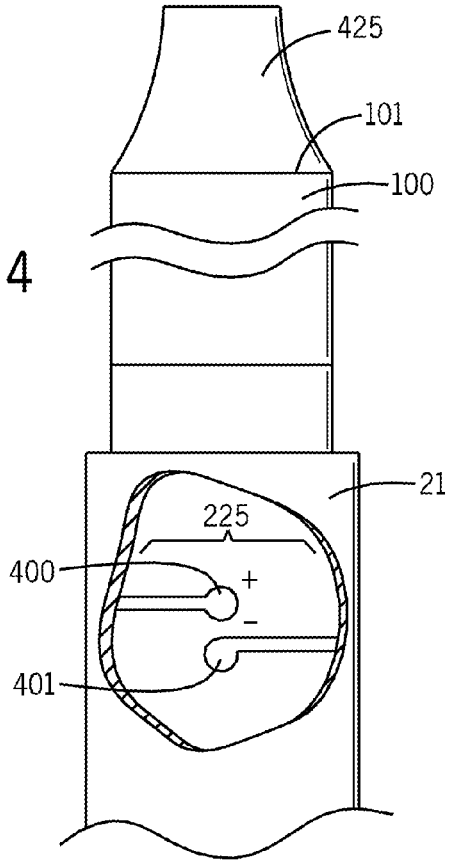
FIG. 4 illustrates a perspective view of the handle section wherein a handle section has a vacuum activated switch instead of a button.

Referring now to FIG. 4, as an alternative to the button 45 of the handle section 21 activating the device 1, the device 1 may have a vacuum activated switch 225. Instead of the user pressing the button 45 of the handle section 21 to activate the device 1, the vacuum activated switch 225 may be activated by a person sucking on the first end 101 of the removable mouthpiece 100 of the device 1. More specifically, a flexible electronic flap 400 located within the interior 34 of the handle section 21 (near the first end 30) may be pulled away from a stationary electronic contact 401 also located within the interior 34 of the handle section 21 when a user draws a breath on the first end 101 of the mouthpiece 100 or on an optional extend mouth contact 425 (discussed below) of the first end 101 of the removable mouthpiece 100. When the flexible electronic flap 400 is pulled away from the stationary electronic contact 401, an electrical circuit is broken triggering the heating element 150 to send energy through the electrical wire contact 325 of the handle section 21 to the extended electrical contact 326 of the removable mouthpiece 100 which in turn heats the liquid 140 in the removable cartridge 125 creating the vapor for inhaling. When the user relaxes his or her breath, the electrical contact between the flexible electronic flap 400 and the stationary electrical contact 401 is restored triggering the heating element 150 to stop. It should be noted that the vacuum activated switch 225 may be easily reversed so that the heating element 150 is triggered to heat the liquid 140 when an electrical contact is made as opposed to being broken.

As stated above, in an embodiment, the removable mouthpiece 100 may have an optional extended mouth contact 425 portion. The extended mouth contact 425 portion may be secured to the first end 101 of the mouthpiece 100. The extended mouth contact 425 may be wedged-shaped so as to provide an easier means for the user to inhale. More specifically, the extended mouth contact 425 may be generally flat on the top and the bottom and may narrow in width as it extends away from the handle section 21; similar to that of the reed of a musical instrument. The extended mouth contact 425 may be angled at approximately thirty to sixty degrees and may have an angle substantially similar to the angle of a circular angled shelf 800 (see below) of the main body 20 so that the extended mouth contact 425 may snuggly secure the handle section 21 on the circular angled shelf 800.

The main body 20 of the device 1 may have a plurality of lights 65 located near the top 2 of the main body 20 of the device 1 and a second plurality of lights 65 located near the bottom 3 of the main body 20 of the device 1. In an embodiment, the plurality of lights 65 may be LED lights. In addition to the ornamental nature of the lights 65, the lights 65 at the top 2 of the main body 20 of the device 1 and/or the lights 65 at the bottom 3 of the main body 20 of the device 1 may allow the user to determine if the device 1 is properly receiving power from its power source 60.

Typically, normal and even electronic hookahs have water located within their main body section. The present device 1 completely lacks water. As a result, the present electronic hookah machine 1 is not only lighter in weight during use, but also is more sanitary as there is no chance of transmission of germs via water. Further, in typical hookah machines (normal or electronic), a user must also change the water in order to clean the device properly. For example, in traditional hookah machines having water (normal or electronic), a user must change the water and clean the device thoroughly before switching smoke flavors in order to properly enjoy the new flavor.

In an embodiment, a compressing unit 200 may be located between the electronic flexible wire cable 22 and the main body 20 of the electronic hookah machine 1. The compressing unit 200 may simply provide a liquid and air tight connection seal between the flexible wire cable 22 and the main body 20 of the electronic hookah machine 1.

Figure 6:
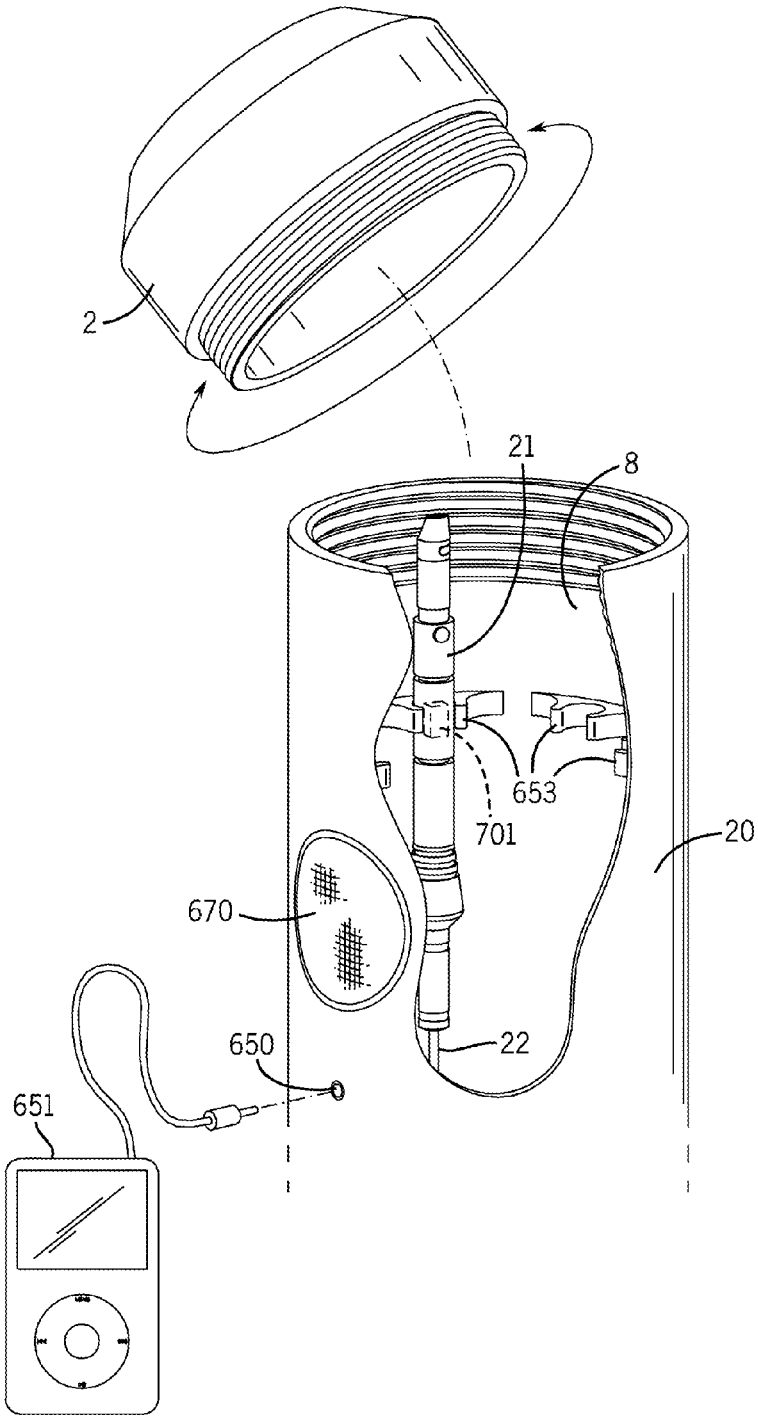
FIG. 6 illustrates a perspective view of the top of the electronic hookah machine.

Referring now to FIG. 6, in an embodiment, the device 1 may have an electrical attachment port 650 for an MP3 player (such as an iPod®) 651. The electrical attachment port 650 may be located on, for example, the main body 20 of the device 1. Speakers 670 may be further present on the main body 20 of the device 1 and may be electrically connected to the electrical attachment port 650 such that a user may connect the MP3 player 651 to the device and may listen to the MP3 player 651 through the device 1.

In an embodiment, the top 2 of the main body portion 20 may unscrew allowing a user to access the interior 8 of the main body portion 20. Within the interior 8 of the main body portion 20 may be a plurality of electrical sockets 653 which may temporarily hold the handle sections 21 when the handle sections 21 are not in use. More specifically, a user may unsecure the flexible wire cable 22 of the handle section 21 from the compressing unit 200 such that the flexible wire cable 22 and the handle section 21 are no longer attached to the main body 20 of the device 1. Once removed, the flexible wire cable 22 and the handle section 21 may be secured in the electrical sockets 653 of the interior 8 of the device 1. Further, in an embodiment, the electrical sockets 653 may charge an optional battery 701 located within the handle section 21 wherein the optional battery 701 may provide energy to heat the liquid 140 of the removable mouthpiece 100 when that specific handle section 21 is not in use.

Figure 7:
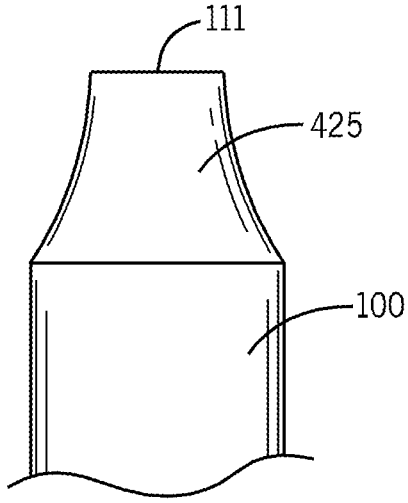
FIG. 7 illustrates a side view of the extend mouth contact of the removable mouthpiece of the device.

In an embodiment, the main body 20 of the device 1 may have a circular angled shelf 800 which surrounds the exterior surface of the main body 20 of the device 1. The circular angled shelf 800 may angle upward at approximately a forty-five degree angle with respect to the main body 20. The angled shelf 800 may have a generally circular support surface 801. A space 802 may be created between the circular support surface 801 and the main body 20. In an embodiment, the circular support surface 801 may be magnetic and may be attracted to the handle section 21 (which, in an embodiment, is metallic) such at a user may place the first end 30 of the handle section 21 in the space 802 of the angled shelf 800 when a user is not using that specific handle section 21. As a result, the handle section 21 remains secured to the main body 20 of the device 1 in a stationary and sanitary manner. Further, the wedge shaped configuration of the angled shelf 800 also allows the extend mouth contact 425 (which is also wedged as illustrated in FIG. 7) to snugly be secured within the angled shelf 800 so that the handle section 21 is further prevented from inadvertently moving.

Finally, in an embodiment, a second shelf 900 may be located near the top 2 of the main body 20 of the device 1. The second shelf 900 may have an opening 901 which may also be used to hold one of the plurality of handle portions 21 when the handle portions 21 are not in use.

Although embodiments of the present invention are shown and described therein, it should be understood that various changes and modifications to the presently preferred embodiments will be apparent to those skilled in the art. Such changes and modifications may be made without departing from the spirit and scope of the present invention and without diminishing its attendant advantages. It is, therefore, intended that such changes and modifications be covered by the appended claims.

The invention claimed is:

1. An electronic hookah machine comprising:

a main body section having an exterior surface and having an interior;

a handle section having a first end, a second end, an exterior surface and an interior;

a flexible wire cable electrically connecting the main body section to the second end of the handle section; and a mouthpiece having a first end, a second end and an interior having a removable cartridge containing a liquid wherein the second end of the mouthpiece is temporarily secured to the first end of the handle section;

a heating element electronically connected to the removable cartridge wherein the heating element transforms the liquid into a vapor;

a power source electrically connected to the heating element; and an angled shelf surrounding the main body section wherein the angled shelf has a generally circular support surface extending approximately thirty to sixty degrees with respect to the main body section;

wherein the circular support surface is magnetic and wherein the circular support surface is magnetically attracted to and temporarily secures the extended mouthpiece of the handle section on the angled shelf.

2. The electronic hookah machine of claim 1 wherein the power source is located within the interior of the main body section wherein the power source is electrically connected to the heating element through the flexible wire cable.

3. The electronic hookah machine of claim 1 wherein the power source is a battery.

4. The electronic hookah machine of claim 1 further comprising:

an extended mouth contact device temporarily secured to the mouthpiece wherein the extended mouth contact device has a first end and a second end wherein the second end of the extended mouth contact is secured to the mouthpiece and wherein the first end is wedged-shaped.

5. The electronic hookah machine of claim 1 further comprising:

a plurality of LED lights located on the main body section wherein the plurality of LED are electrically connected to a power source and wherein the plurality of LED lights indicate if the electronic hookah machine is on.

6. The electronic hookah machine of claim 1 further comprising:

adjustable voltmeter electronically connected to the power source wherein the adjustable voltmeter allows a user to adjust the amount of power reaching the heating element.

7. The electronic hookah machine of claim 1 wherein the heating element is located within the interior of the handle section.

8. The electronic hookah machine of claim 1 further comprising:

an electrical socket located within the interior of the main body section and electrically connected to the power source wherein the electrical socket temporarily charges and stores the handle section when the handle section is not in use.

9. The electronic hookah machine of claim 1 further comprising:

a vacuum activated switch within the mouthpiece wherein the vacuum activated switch activates the heating element when a user inhales on the mouthpiece.

10. The electronic hookah machine of claim 1 further comprising:

an electrical attachment port on the exterior surface of the main body section wherein the electrical attachment port is electrically connected to the power source and wherein an MP3 player is attached to the electrical attachment port.

11. The electronic hookah of claim 1 further comprising:

a second shelf surrounding the main body section wherein the second shelf has an opening for receiving and storing the handle section when the handle section is not in use.

12. The electronic hookah of claim 1 wherein the mouthpiece is secured to the handle section via a helical threaded portion.

13. The electronic hookah of claim 1 further comprising:

an extending male protrusion section of the handle section wherein the extended male protrusion has a circumference which is less than a circumference of a main body of the handle section;

a female connection point of the mouthpiece wherein the female connection has an opening slightly larger than the circumference of the extending male protrusion wherein the extended male protrusion section snaps into and is secured to the female connection point of the mouthpiece; and a rubber or metal gasket located between the extended male protrusion section and the female connection point wherein the rubber or metal gasket provides a liquid and air tight seal between the removable mouthpiece and the handle section.

14. The electronic hookah of claim 1 further comprising:

a button located on the handle section wherein the button activates the electronic hookah by mechanically producing an electrical contact between an electronic flexible wire cable located within the interior of the handle section and the power source.

15. The electronic hookah of claim 1 wherein the main body section has a top which is unscrewed allowing access to the interior of the main body section wherein a plurality of electrical sockets are located within the interior of the main body section wherein the electrical sockets temporarily secure the handle sections when not in use and wherein the electrical sockets charge a battery located within the handle section.

* * * * *